US006401279B1

(12) United States Patent
Vaughn

(10) Patent No.: US 6,401,279 B1
(45) Date of Patent: Jun. 11, 2002

(54) NECK SUPPORTING PILLOW

(76) Inventor: Jesse F. Vaughn, 360 Grand Ave. #300, Oakland, CA (US) 94610

( * ) Notice: Subject to any disclaimer, the term of this patent is extended or adjusted under 35 U.S.C. 154(b) by 0 days.

(21) Appl. No.: 09/523,120

(22) Filed: Mar. 10, 2000

(51) Int. Cl.[7] ..... A47G 9/00
(52) U.S. Cl. ..... 5/644; 5/645
(58) Field of Search ..... 5/644, 645, 636, 5/654, 655.3, 655.5

(56) References Cited

U.S. PATENT DOCUMENTS

| | | | | |
|---|---|---|---|---|
| 3,757,365 A | | 9/1973 | Kretchmer | |
| 4,192,029 A | | 3/1980 | Bond | |
| 4,536,905 A | | 8/1985 | Desantis | |
| 4,724,560 A | * | 2/1988 | Christie | 5/644 |
| D308,785 S | | 6/1990 | Sapp et al. | |
| 5,535,468 A | | 7/1996 | Mallernee | |
| 5,797,154 A | | 8/1998 | Contreras | |

* cited by examiner

*Primary Examiner*—Alexander Grosz

(57) ABSTRACT

A neck supporting pillow for maintaining a clear air passage through a user's neck while the user is sleeping. The neck supporting pillow includes a pillow comprising an outer wall having opposed side ends and a concave top side, and further includes an inner wall, an internally-disposed inner chamber, and an internally-disposed outer chamber being separated from the inner chamber with the inner wall and having an upper compartment and a lower compartment being separated by an annular divider; and further includes a plurality of support members which are essentially planar and made of fabric material, each of the support members extending at a slant from the inner wall to a respective side end of the outer wall; and also includes a plurality of valve member disposed in and through the inner wall to control flow of liquid or air between the inner chamber and the outer chamber.

9 Claims, 2 Drawing Sheets

NECK SUPPORTING PILLOW

BACKGROUND OF THE INVENTION

1. Field of the Invention

The present invention relates to a chiropractic pillow and more particularly pertains to a new neck supporting pillow for maintaining a clear air passage through a user's neck while the user is sleeping.

b 2.Description of the Prior Art

The use of a chiropractic pillow is known in the prior art. More specifically, chiropractic pillow heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,192,029; 4,536,905; 5,535,468; 3,757,365; U.S. Pat. No. Des. 308,785; and U.S. Pat. No. 5,797,154.

While these devices fulfill their respective, particular objectives and requirements, the aforementioned patents do not disclose a new neck supporting pillow. The inventive device includes a pillow comprising an outer wall having opposed side ends and a concave top side, and further includes an inner wall, an internally-disposed inner chamber, and an internally-disposed outer chamber being separated from the inner chamber with the inner wall and having an upper compartment and a lower compartment being separated by an annular divider; and further includes a plurality of support members which are essentially planar and made of fabric material, each of the support members extending at a slant from the inner wall to a respective side end of the outer wall; and also includes a plurality of valve member disposed in and through the inner wall to control flow of liquid or air between the inner chamber and the outer chamber.

In these respects, the neck supporting pillow according to the present invention substantially departs from the conventional concepts and designs of the prior art, and in so doing provides an apparatus primarily developed for the purpose of maintaining a clear air passage through a user's neck while the user is sleeping.

SUMMARY OF THE INVENTION

In view of the foregoing disadvantages inherent in the known types of chiropractic pillow now present in the prior art, the present invention provides a new neck supporting pillow construction wherein the same can be utilized for maintaining a clear air passage through a user's neck while the user is sleeping.

The general purpose of the present invention, which will be described subsequently in greater detail, is to provide a new neck supporting pillow which has many of the advantages of the chiropractic pillow mentioned heretofore and many novel features that result in a new neck supporting pillow which is not anticipated, rendered obvious, suggested, or even implied by any of the prior art chiropractic pillow, either alone or in any combination thereof.

To attain this, the present invention generally comprises a pillow comprising an outer wall having opposed side ends and a concave top side, and further includes an inner wall, an internally-disposed inner chamber, and an internally-disposed outer chamber being separated from the inner chamber with the inner wall and having an upper compartment and a lower compartment being separated by an annular divider; and further includes a plurality of support members which are essentially planar and made of fabric material, each of the support members extending at a slant from the inner wall to a respective side end of the outer wall; and also includes a plurality of valve member disposed in and through the inner wall to control flow of liquid or air between the inner chamber and the outer chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent And Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new neck supporting pillow which has many of the advantages of the chiropractic pillow mentioned heretofore and many novel features that result in a new neck supporting pillow which is not anticipated, rendered obvious, suggested, or even implied by any of the prior art chiropractic pillow, either alone or in any combination thereof.

It is another object of the present invention to provide a new neck supporting pillow which may be easily and efficiently manufactured and marketed.

It is a further object of the present invention to provide a new neck supporting pillow which is of a durable and reliable construction.

An even further object of the present invention is to provide a new neck supporting pillow which is susceptible of a low cost of manufacture with regard to both materials and labor, and which accordingly is then susceptible of low prices of sale to the consuming public, thereby making such neck supporting pillow economically available to the buying public.

Still yet another object of the present invention is to provide a new neck supporting pillow which provides in the apparatuses and methods of the prior art some of the advantages thereof, while simultaneously overcoming some of the disadvantages normally associated therewith.

Still another object of the present invention is to provide a new neck supporting pillow for maintaining a clear air passage through a user's neck while the user is sleeping.

Yet another object of the present invention is to provide a new neck supporting pillow which includes a pillow comprising an outer wall having opposed side ends and a concave top side, and further includes an inner wall, an internally-disposed inner chamber, and an internally-disposed outer chamber being separated from the inner chamber with the inner wall and having an upper compartment and a lower compartment being separated by an annular divider; and further includes a plurality of support members which are essentially planar and made of fabric material, each of the support members extending at a slant from the inner wall to a respective side end of the outer wall; and also includes a plurality of valve member disposed in and through the inner wall to control flow of liquid or air between the inner chamber and the outer chamber.

Still yet another object of the present invention is to provide a new neck supporting pillow that is very comfortable and essentially ensures a non-blocked air passageway.

Even still another object of the present invention is to provide a new neck supporting pillow that essentially alleviates a user's excessive snoring or breathing difficulties.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
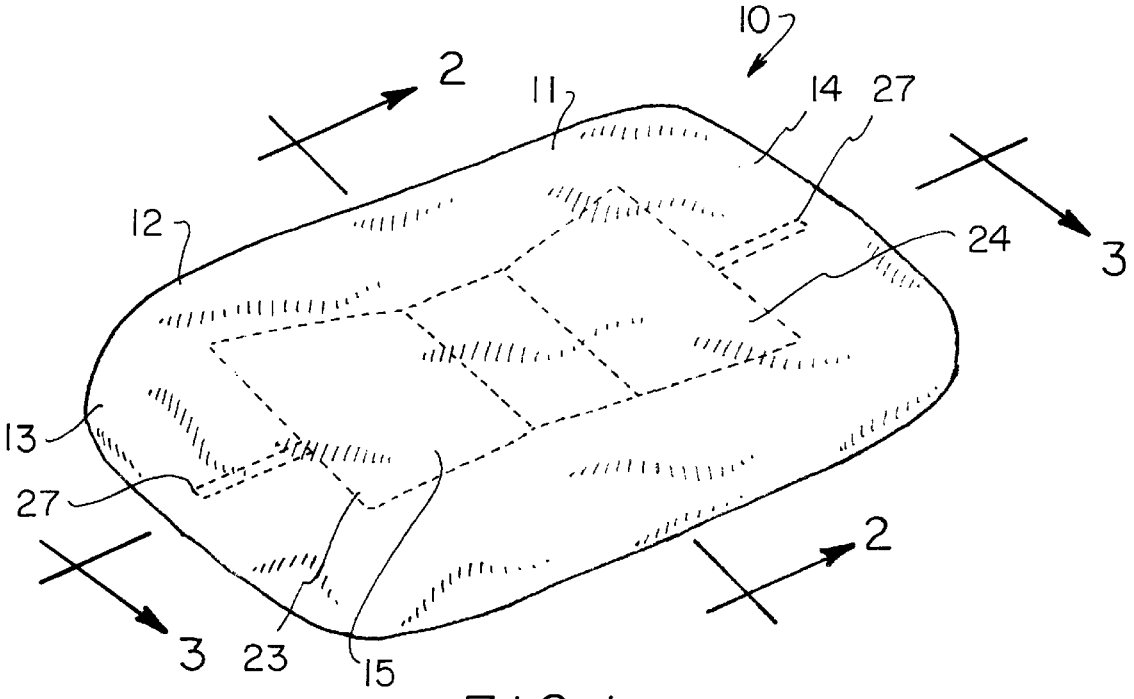
FIG. 1 is a perspective view of a new neck supporting pillow according to the present invention.
Figure 2:
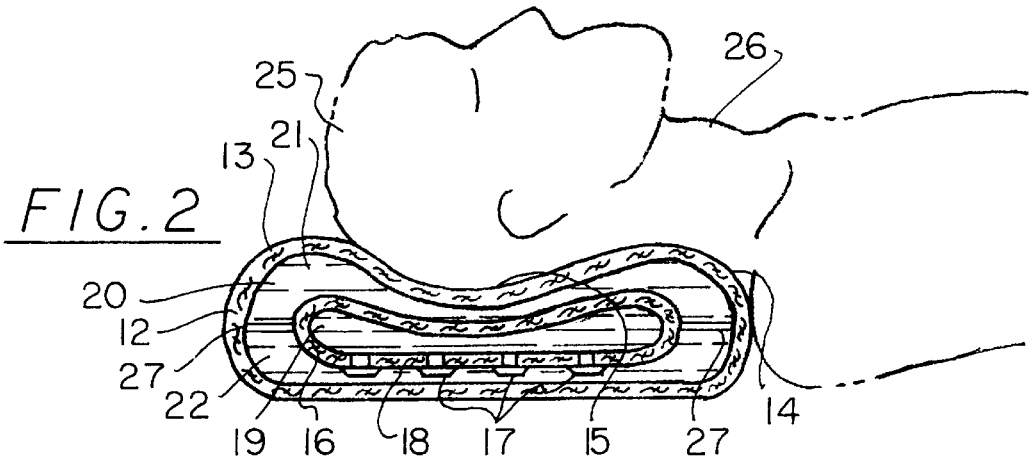
FIG. 2 is a side cross-sectional view of the present invention being used.
Figure 3A:
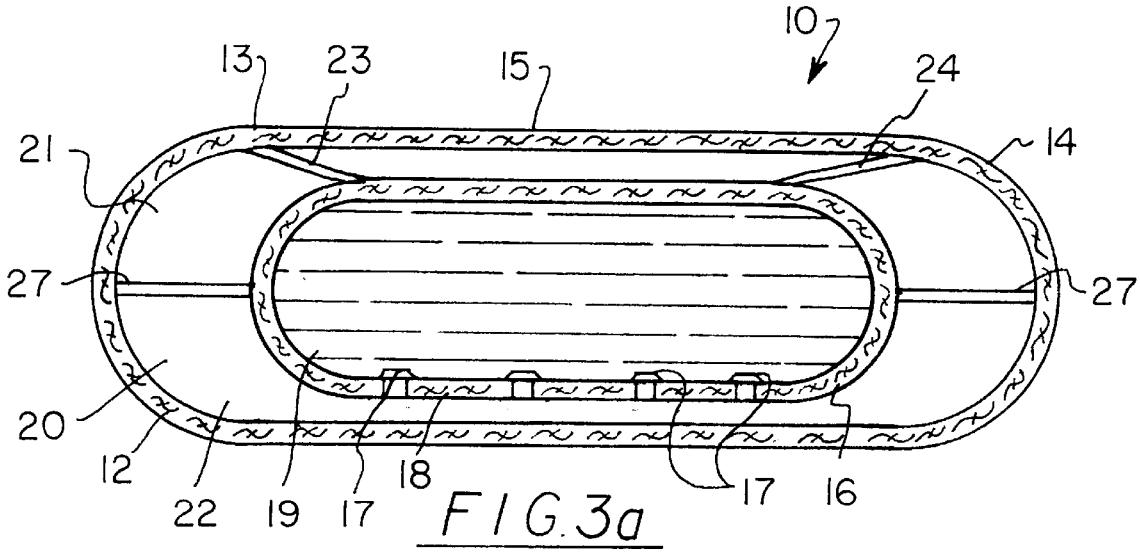
FIG. 3*a* is an end cross-sectional view of the present invention not being used.
Figure 3B:
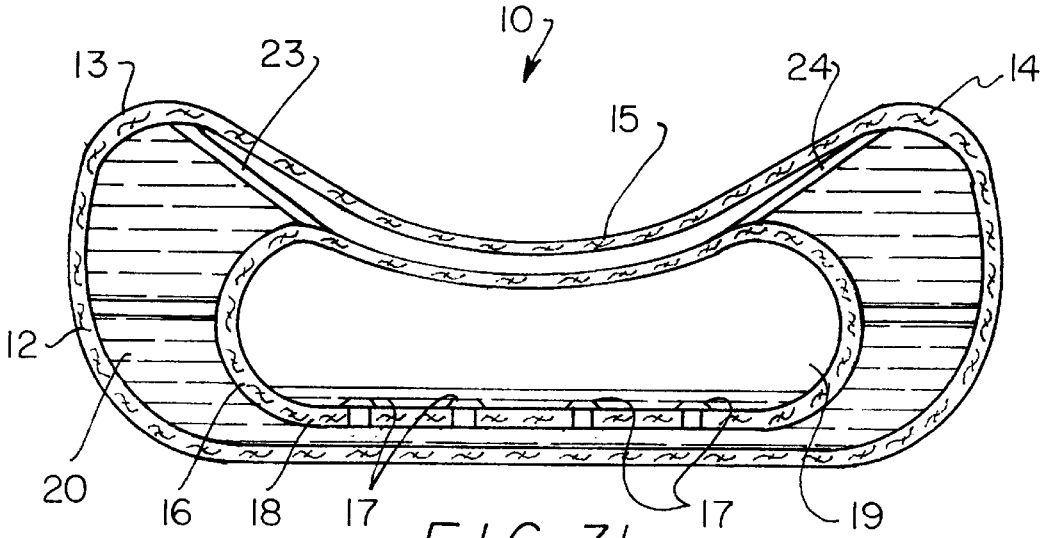
FIG. 3*b* is an end cross-sectional view of the present invention being used.

With reference now to the drawings, and in particular to FIGS. 1 through 3*b* thereof, a new neck supporting pillow embodying the principles and concepts of the present invention and generally designated by the reference numeral 10 will be described.

As best illustrated in FIGS. 1 through 3*b,* the neck supporting pillow 10 generally comprises the pillow 11 including an outer wall 12 having opposed side ends 13,14, an inner wall 16, an internally-disposed inner chamber 19, an internally-disposed outer chamber 20 disposed about the inner chamber 19 and separated from the inner chamber 19 by the inner wall 16. The inner and outer chambers 19,20 are adapted to contain either liquid, air, or foam. The outer wall 12 includes a concave top side 15 for properly supporting a user's head 25 with the perimeter of the top side 15 being adapted to support the user's neck 26 to maintain a straight air passage therethrough. The outer chamber 20 includes an upper compartment 21 and a lower compartment 22 which is separated by an annular divider 27 which is securely and conventionally attached to the outer wall 12 and to the inner wall 16. A plurality of conventional valve members 17 are securely and conventionally disposed in and through the inner wall 16 to allow either liquid or air to move between the inner and outer chambers 19,20 with the valve members 17 being disposed in a bottom side 18 of the inner wall 16 and interconnecting the inner chamber 19 to the lower compartment 21 of the outer chamber 19. A plurality of semi-rigid support members 23,24 are securely and conventionally disposed and sewn in the outer chamber 20 to essentially keep a user's neck 26 straight while a user is lying prone. The semi-rigid support members 23, 24 are essentially planar with one of the support members 23 extending at a slant from the inner wall 16 toward one of the side ends 13 of the outer wall 12 and with another of the support members 24 extending at a slant from the inner wall 16 toward the other of the side ends 14 of the outer wall 12. The support members 23, 24 essentially maintain the concave shape of the top side 15 of the outer wall 12 with the support members 23, 24 being adapted to essentially extend upwardly at an angle to either side of the user's head 25 lying on the pillow. The support members 23, 24 have ends securely attached to the inner wall 16 and to the outer wall 12. The support members 23, 24 are essentially made of fabric material.

In use, the user lies one's head 25 upon the top side 15 of the outer wall 12 of the pillow 11 with the liquid or air being urged from the inner chamber 19 to the outer chamber 20 so that the perimeter about the top side 15 of the outer wall 12 especially along a front end of the pillow 11 is urged upwardly to support and keep the user's neck 26 straight so that the air passage is not blocked in any way.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A neck supporting pillow comprising:

a pillow including an outer wall having opposed side ends, an inner wall, an internally-disposed inner chamber, an internally-disposed outer chamber disposed about said inner chamber and separated from said inner chamber by said inner wall, said inner and outer chambers being adapted to contain either liquid, or air;

a plurality of valve members securely disposed in and through said inner wall to allow either liquid or air to move between said inner and outer chambers; and a plurality of support members disposed in said outer chamber to keep a user's neck straight while a user is lying supine;

wherein said outer wall includes a concave top side for supporting a user's head with the perimeter of said top side being adapted to support the user's neck to maintain a straight air passage therethrough; and wherein said support members are substantially planar with one of said support members extending at a slant from said inner wall toward one of said side ends of said outer wall and with another of said support members extending at a slant from said inner wall toward the other of said side ends of said outer wall, said support members substantially maintaining said concave shape of said top side of said outer wall.

2. A neck supporting pillow as described in claim 1, wherein said outer chamber includes an upper compartment and a lower compartment which is separated by an annular divider which is securely attached to said outer wall and to said inner wall.

3. A neck supporting pillow as described in claim 2, wherein said valve members are disposed in a bottom side of said inner wall and interconnect said inner chamber to said lower compartment of said outer chamber.

4. A neck supporting pillow as described in claim 1, wherein said support members have ends attached to said inner wall and to said outer wall.

5. A neck supporting pillow as described in claim 1, wherein said support members are adapted to extend upwardly at a slant to either side of the user's head lying on said pillow.

6. A neck supporting pillow as described in claim 1, wherein said support members have ends attached to said inner wall and to said outer wall.

7. A neck supporting pillow comprising:

a pillow including an outer wall having opposed side ends, an inner wall, an internally-disposed inner chamber, an internally-disposed outer chamber disposed about said inner chamber and separated from said inner chamber by said inner wall, said inner and outer chambers being adapted to contain either liquid, or air;

a plurality of valve members securely disposed in and through said inner wall to allow either liquid or air to move between said inner and outer chambers; and a plurality of semi-rigid support members securely disposed in said outer chamber to essentially keep a user's neck straight while a user is lying supine;

wherein said outer wall includes a concave top side for properly supporting a user's head with the perimeter of said top side being adapted to support the user's neck to maintain a straight air passage therethrough;

wherein said outer chamber includes an upper compartment and a lower compartment which is separated by an annular divider which is securely attached to said outer wall and to said inner wall;

wherein said valve members are disposed in a bottom side of said inner wall and interconnect said inner chamber to said lower compartment of said outer chamber; and wherein said semi-rigid support members are essentially planar with one of said support members extending at a slant from said inner wall toward one of said side ends of said outer wall and with another of said support members extending at a slant from said inner wall toward the other of said side ends of said outer wall, said support members essentially maintaining said concave shape of said top side of said outer wall.

8. A neck supporting pillow as described in claim 7, wherein said support members are adapted to extend upwardly at a slant to either side of the user's head lying on said pillow.

9. A neck supporting pillow comprising:

a pillow including an outer wall having opposed side ends, an inner wall, an internally-disposed inner chamber, an internally-disposed outer chamber disposed about said inner chamber and separated from said inner chamber by said inner wall, said inner and outer chambers being adapted to contain either liquid or air, said outer wall including a concave top side for properly supporting a user's head with the perimeter of said top side being adapted to support the user's neck to maintain a straight air passage therethrough, said outer chamber including an upper compartment and a lower compartment which is separated by an annular divider which is securely attached to said outer wall and to said inner wall;

a plurality of valve members securely disposed in and through said inner wall to allow either liquid or air to move between said inner and outer chambers, said valve members being disposed in a bottom side of said inner wall and interconnecting said inner chamber to said lower compartment of said outer chamber; and a plurality of semi-rigid support members securely disposed in said outer chamber to essentially keep a user's neck straight while a user is lying supine, said semi-rigid support members being essentially planar with one of said support members extending at a slant from said inner wall toward one of said side ends of said outer wall and with another of said support members extending at a slant from said inner wall toward the other of said side ends of said outer wall, said support members essentially maintaining said concave shape of said top side of said outer wall, said support members being adapted to essentially extend upwardly at a slant to either side of the user's head lying on said pillow, said support members having ends securely attached to said inner wall and to said outer wall, said support members being essentially made of fabric material.

* * * * *